US011778395B2

(12) United States Patent
Henriksen

(10) Patent No.: US 11,778,395 B2
(45) **Date of Patent: *Oct. 3, 2023**

(54) HEARING AID BATTERY CONNECTED TO EAR SHELL

(71) Applicant: Oticon A/S, Smørum (DK)

(72) Inventor: Poul Henriksen, Veksø (DK)

(73) Assignee: Oticon A/S, Smørum (DK)

( * ) Notice: Subject to any disclaimer, the term of this patent is extended or adjusted under 35 U.S.C. 154(b) by 0 days.

This patent is subject to a terminal disclaimer.

(21) Appl. No.: 17/873,758

(22) Filed: Jul. 26, 2022

(65) Prior Publication Data

US 2022/0369051 A1 Nov. 17, 2022

Related U.S. Application Data

(63) Continuation of application No. 17/067,142, filed on Oct. 9, 2020, now Pat. No. 11,432,083.

(30) Foreign Application Priority Data

Oct. 9, 2019 (EP) ..... 19202284

(51) Int. Cl.
*H04R 25/00* (2006.01)

(52) U.S. Cl.
CPC ..... *H04R 25/602* (2013.01); *H04R 25/658* (2013.01); *H04R 2225/025* (2013.01); *H04R 2225/31* (2013.01)

(58) Field of Classification Search
CPC .... H04R 25/602; H04R 25/658; H04R 25/65; H04R 25/652; H04R 2225/025; H04R 25/60; Y10T 29/49572
USPC ..... 381/312, 322, 324
See application file for complete search history.

(56) References Cited

U.S. PATENT DOCUMENTS

| | | | |
|---|---|---|---|
| 2,971,065 | A | 2/1961 | Busse |
| 3,852,540 | A | 12/1974 | Diethelm |
| 2004/0081328 | A1 | 4/2004 | Leedom et al. |
| 2011/0317846 | A1 | 12/2011 | Yuan et al. |
| 2014/0376755 | A1 | 12/2014 | Kang |
| 2015/0230036 | A1 | 8/2015 | Pedersen et al. |

(Continued)

FOREIGN PATENT DOCUMENTS

| | | | |
|---|---|---|---|
| DE | 415944 | C | 7/1925 |
| WO | WO 2019/086119 | A1 | 5/2019 |

OTHER PUBLICATIONS

Partial European Search Report for European Application No. 20200180.6, dated Mar. 5, 2021.

*Primary Examiner* — George C Monikang
(74) *Attorney, Agent, or Firm* — Birch, Stewart, Kolasch & Birch, LLP

(57) ABSTRACT

There is presented an in-the-ear hearing aid comprising a faceplate, an ear shell, such as a custom ear shell, and a battery, wherein the battery is fixed to the ear shell and furthermore a method for providing an in-the-ear hearing aid, said method comprising obtaining data, such as three-dimensional data, representative of a shape and/or size of an ear canal of a specific person, such as the part of an ear canal extending at least partially from the outer ear to the middle ear, establishing a digital model of the ear shell, such as the custom ear shell, of the hearing aid for said ear canal based on said data, wherein said providing includes determining a position and/or orientation of a battery in said ear shell, which position and/or orientation increases or maximizes a distance from the outer ear to the faceplate.

12 Claims, 2 Drawing Sheets

(56) References Cited

U.S. PATENT DOCUMENTS

| | | | |
|---|---|---|---|
| 2016/0381471 | A1 | 12/2016 | Henriksen et al. |
| 2018/0035195 | A1 | 2/2018 | Bjelosevic et al. |

HEARING AID BATTERY CONNECTED TO EAR SHELL

This application is a Continuation of copending application Ser. No. 17/067,142, filed on Oct. 9, 2020, which claims priority under 35 U.S.C. § 119(a) to Application No. 19202284.6, filed in Europe on Oct. 9, 2019, all of which are hereby expressly incorporated by reference into the present application.

FIELD

The present disclosure relates to an in-the-ear hearing aid. More particularly, the disclosure relates to in-the-ear hearing aids where the battery is connect to the ear shell (such as floating with respect to the faceplate), such as for enabling reducing a size of the in-the-ear hearing aid, and the present disclosure furthermore relates to a corresponding method and binaural system.

BACKGROUND

The size of an in-the-ear hearing aid may be considered an important parameter, e.g., as it dictates the amount of users the instruments can fit and/or because a smaller size is advantageous for reducing or eliminating the visual appearance of the hearing aid when placed in the ear canal of a user. Therefore, there is a need to provide a solution that enables reducing size.

SUMMARY

According to a first aspect, there is provided an in-the-ear hearing aid comprising:

A faceplate

An ear shell, such as a custom ear shell, and

A battery, wherein the battery may be fixed to the ear shell.

When designing a custom Hearing Instrument, one of many constraints are the placement and orientation of microphones typically dictated to the audio design (e.g. directionality). Another constraint is the placement of the battery that typically is fixed to the faceplace by its integrated battery drawer. Each Hearing Instrument is made to fit the individual user's ear canal and as it needs to have room for all the parts that the Hearing Instrument is made from, the shape of the parts and their placements become a restriction in the design and subsequently size of the Instrument. The Instrument size is an important parameter as it dictates the amount of users the instruments can fit. The ear shell and the faceplate are most often directly interconnected, i.e. the two are connected directly. Traditionally, a faceplace is manucatured first, and a custom part is formed according to the shape of an intended user's actual ear canal and attached to the faceplate.

An advantage of fixing the battery to the ear shell may be that there may then be no restrictions with respect to the orientation of the battery, such as the orientation of the battery with respect to the faceplate, which may in turn entail that the position and/or orientation of the battery may be optimized with respect to a size of the in-the-ear hearing aid, which may then in turn enable that the in-the-ear hearing aid may be less visible or not visible at all during use.

Support for holding the battery in a desired position and/or orientation may be part of the ear shell, such as the ear shell being a custom made outer shell of the in-the-ear hearing aid, and/or a formable part interfacing the faceplate.

By 'hearing aid' may generally be understood a hearing device adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal. An 'in-the-ear hearing aid' may be understood as is common in the art, such as a hearing aid adapted to be worn entirely or partly in the pinna and/or in the ear canal of the user. An 'in-the-ear' type hearing aid may be understood to encompass also 'In-the-Canal' and/or 'Completely-in-Canal' hearing aids.

In the present description, the in-the-ear hearing aid may be an 'In-the-Canal' hearing aid and/or a 'Completely-in-Canal' hearing aid and/or a Invisibly In Canal (IIC) hearing aid and/or a Completely In Canal (CIC) hearing aid.

According to the present description, there is presented an in-the-ear hearing aid, wherein the battery is placed out of contact with the faceplate, such as not in contact with the faceplate, such as abutting or adjoining or touching the faceplate. A possible advantage of placing the battery out of contact, or at least with only little contact, with the faceplate may be that the position and/or the orientation of the battery may be kept independent of the faceplate. Another possible advantage of placing the battery out of contact with the faceplate may be that the faceplate can be removed without interfering with the position and/or orientation of the battery. Also, the faceplate may be formed without an opening for a battery lid or battery compartment, which provide a further degree of freedom by freeing up the faceplate for other purposes such as charge terminals or antenna or push-buttons or volume wheels or other interface components or vent holes. This may also allow even smaller hearing instruments having smaller cross-sections so that they may fit in the ear canal of a wider variety of people. Another possible advantage of placing the battery out of contact with the faceplate may be that the ear shell and battery may be assembled prior to mounting of the faceplate.

According to the present description, there is presented an in-the-ear hearing aid, wherein the battery floats relative to the faceplate and/or to the interior surfaces of the sidewall, such as relative to a custom shaped part of the in-the-ear hearing aid. If the battery in the in-the-ear hearing aid is not fixed to the faceplate but can float freely relatively to the faceplate, this allow designing the in-the-ear housing to fit optimally in the ear canal; e.g. by rotate and/or tilt the battery relative to faceplate, thereby allowing in-the-ear hearing aids to be made smaller and a better fit-rate is obtained, i.e. more users can be fitted with the similar type in-the-ear hearing aids. In other hearing aids, the restriction that the battery is fixed to the faceplate, e.g. in a battery drawer, restrains the size of the hearing aid to a minimum size that might not fit all people. This is e.g. the case when a relatively large battery, such as a size 13 battery, is stored in a battery drawer attached to the faceplate, which then require certain placement of other components, e.g. microphones, buttons etc., which again result in a certain size, such as a diameter, which in the end means that the hearing aid might not fit the person for which it is intended. It is advantageous that the battery may be fixed to the shell, such as to a custom shaped part of the in-the-ear housing, after the design phase where a program or user has laid out the position of components of the hearing aid.

By 'rotation' is meant that the battery is able to rotate not around a central battery axis defined at the center of a circular battery, but rotating e.g. around an axis that is transverse to the central battery axis, so that the battery may be positioned in the custom part in a way that allow the custom part to be as small as possible.

A floating battery is possible and advantageous, especially when considering a rechargeable battery where the battery drawer and its restrictions are removed. By 'the battery floats relative to the faceplate' may be understood that the position and/or orientation of the battery may be varied with respect to the faceplate, possibly also after the in-the-ear housing has been assembled.

According to the present description, there is presented an in-the-ear hearing aid, wherein the battery may be fixed to the ear shell independently of the faceplate, such as glued to the ear shell and/or fixed to the ear shell via an interference fit and/or via a protruding structure on the inner surface of the ear shell and/or via a structure attached to the inner surface of the ear shell. By 'fixed to the ear shell independently of the faceplate' may be understood that the battery is fixed to the ear shell and said fixation is independent of the faceplate, such as the faceplate may be removed while the battery is still fixed to the ear shell. It is still encompassed that the battery may also be fixed to the faceplate, i.e., the battery may be fixed both to the ear shell and the faceplate or fixed exclusively to the ear shell. An advantage of the battery being fixed to the ear shell independently of the faceplate may be that it enables removing or mounting the faceplate while the battery is (or remains) fixed to the ear shell. Another advantage of having the battery fixed to the ear shell independently of the faceplate may be that it enables positioning and/or orienting the battery optimally with a view to reduce or minimize a size of the in-the-ear hearing aid.

According to the present description, there is presented an in-the-ear hearing aid, wherein the battery may be fixed exclusively to the ear shell, such as glued to the ear shell and/or fixed to the ear shell via an interference fit and/or via a protruding structure on the inner surface of the ear shell and/or via a structure attached to the inner surface of the ear shell. An advantage of the battery being fixed exclusively to the ear shell may be that it enables removing or mounting other parts, such as the faceplate, while the battery is (or remains) fixed to the ear shell. Another advantage of having the battery fixed to the ear shell independently of the faceplate may be that it enables positioning and/or orienting the battery optimally with a view to reduce or minimize a size of the in-the-ear hearing aid. By an 'interference fit' may also be known as a press fit or a friction fit and may be understood as a fastening between two parts, which is achieved by friction after the parts are pushed together, rather than by any other means of fastening.

According to the present description, there is presented an in-the-ear hearing aid, wherein a center axis of the battery , such as an axis for which the battery has a minimum moment of inertia and/or an axis around which the battery exhibits circular symmetry, is neither orthogonal to nor parallel with a plane of the faceplate, such as a best-fit mathematical plane with respect to the faceplate, such as wherein an angle between said axis and said plane is within [5°; 85°], such as within [10°; 80°], such as within [20°; 70°], such as within [30°; 60°]. A possible advantage of the center axis of the battery being neither orthogonal to nor parallel with a plane of the faceplate, may be that it enables an improved orientation of the battery for the purpose of reducing or minimizing a size of the in-the-ear hearing aid.

According to the present description, there is presented an in-the-ear hearing aid, wherein the battery is a rechargeable battery. An advantage of having a rechargeable battery may be that it may render it superfluous to replace the battery for continued operation of the in-the-ear hearing aid once the energy in the battery has been consumed. In the present description, the rechargeable battery may be recharged without necessitating removing the battery from in-the-ear hearing aid, such as wherein the battery may be recharged via electrical contacts being accessible without removing the battery, such as electrical contacts being accessible at an exterior part of the in-the-ear hearing aid, or wherein the battery may be recharged wirelessly, such as via an induction coil. An advantage of being able to recharge the battery without removing it may be that it enables dispensing with the restriction that the battery should be removable or even replaceable, such as easily removable or easily replaceable, which may in turn remove a restriction that the battery should be placed and oriented in a particular way in the in-the-ear hearing aid, which place and orientation might not be optimal for the purpose of reducing or minimizing a size of the hearing aid.

According to the present description, there is presented an in-the-ear hearing aid, wherein the battery (106) is a rechargeable battery, and wherein the hearing aid may further comprise an induction coil configured for wireless charging of the rechargeable battery. Alternatively, or additionally, contact charging pads may be included. The induction coil may be further configured for communication, such as being operable between the two states (i.e. charging and communication) or even simultaneous charging and communication, such as intermittent charging and communicating, which may be perceived as both occurring simultaneously.

According to the present description, there is presented an in-the-ear hearing aid, wherein the faceplate comprises an antenna configured for high frequency wireless communication, such as an antenna configured with an operating frequency of 2.4 GHz or 5.8 GHz. A possible advantage of this may be that it yields an, such as another, channel of communication. By 'configured with an operating frequency of 2.4 GHz' may be understood suitable for the 2.4 GHz industrial, scientific and medical (ISM) radio band. By 'antenna configured with an operating frequency of 2.4 GHz' may be understood an antenna suitable for transmission and/or receipt of electromagnetic signals within the 2.4 GHz ISM band and/or within the wavelength range [2.4; 2.5] GHz. By 'configured with an operating frequency of 5.8 GHz' may be understood suitable for the 5.8 GHz industrial, scientific and medical (ISM) radio band. By 'antenna configured with an operating frequency of 5.8 GHz' may be understood an antenna suitable for transmission and/or receipt of electromagnetic signals within the 5.8 GHz ISM band and/or within the wavelength range [5.725; 5.875] GHz.

According to the present description, there is presented an in-the-ear hearing aid, wherein the faceplate comprises one or more microphones, such as one microphone, such as two microphones.

According to the present description, there is presented an in-the-ear hearing aid, wherein the battery is fixed to the ear shell (104) via protrusions, possibly monolithically, integrated with the ear shell. Said protrusions may enable an interference fit.

According to the present description, there is presented an in-the-ear hearing aid comprising a substrate carrying at least one electronic component wherein said substrate carrying at least one electronic component floats relative to the faceplate or is attached to the faceplate.

According to the present description, there is presented an in-the-ear hearing aid, wherein a protection layer is applied to at least one electronic component in the in-the-ear hearing aid. If a protection layer, such as a thin layer of liquid protection, such as epoxy or silicone or polyurethane (PU)) is applied on at least one electronic component, such as the integrated circuits (ICs), such as especially the edges of the ICs, the risk of damage may be dramatically reduced. The effect of the protection layer may vary with the properties, such as the effects being one or more of the effects in the following non-exhaustive list: Stabilization through filling of (micro-) cracks and/or added force distribution layer and/or cushioning.

According to the present description, there is presented an in-the-ear hearing aid, wherein the ear shell is monolithic, such as made in one part, such as 3D printed. Alternatively, or also, the shell may be initially be produced polylithically and then later assembled to form a single piece. A possible advantage of having the ear shell monolithic may be that it enables one or more of simplified production, simplified assembly and or increased resistance against moisture and liquids.

According to the present description, there is presented an in-the-ear hearing aid, wherein the in-the-ear hearing aid comprises a housing, said housing comprising the faceplate and the ear shell , and wherein the in-the-ear hearing aid further comprises a telecoil arranged within the housing.

According to a second aspect, there is presented a plurality of in-the-ear hearing aids according to the first aspect, such as wherein the electronic components are identical across the plurality of hearing aids, wherein the shape and/or size of the ear shells are different with respect to each other, such as wherein the shape and/or size of the ear shells are shaped for respective left and right ears of a specific person, wherein the ear shells have different geometries with respect to each other, and wherein the positions and/or orientations of the batteries with respect to the respective faceplates are different with respect to each other.

A possible advantage of having the shape and/or size of the ear shells being different with respect to each other may be that the in-the-ear hearing aids may then fit different users, such as each in-the-ear hearing aid may be optimized to a specific user. A possible advantage of having the positions and/or orientations of the batteries with respect to the faceplates being different with respect to each other may be that it enables minimizing or reducing a size of each individual in-the-ear hearing aid.

According to a third aspect, there is presented a binaural system comprising two in-the-ear hearing aids according to the first aspect. In the present description, the hearing aids may be configured as a "binaural (hearing) system", such as a system comprising two hearing aids where the two hearing aids are adapted to cooperatively provide audible signals to both of the user's ears.

According to a fourth aspect, there is presented a method for providing an in-the-ear hearing aid, such as an in-the-ear hearing aid according to the first aspect, said method comprising:

Obtaining data, such as three-dimensional data, representative of a shape and/or size of an ear canal of a specific person, such as the part of an ear canal extending at least partially from the outer ear to the middle ear, establishing a digital model of the ear shell, such as the custom ear shell, of the hearing aid for said ear canal based on said data, wherein said providing includes determining a position and/or orientation of a battery in said ear shell, which position and/or orientation increases or maximizes a distance from the outer ear to the faceplate. This method may be beneficial for receiving information regarding the geometry of the ear canal and providing information, such as a computer aided design (CAD) model or another digital model, of an ear shell for said ear canal, wherein a position and/or orientation of a battery is optimized with a view to minimize or reduce a size of said ear shell (and/or maximize a distance from the outer ear to the faceplate, which maximization may reduce or eliminate the visibility of the in-the-ear hearing aid during use). A result of this method may be information relating to an ear shell, such as a digital model of the ear shell.

It may be considered a basic insight of the present inventors, that the position and/or orientation of the battery may advantageously be optimized during the design of the in-the-ear hearing aid, such as at least during the design of a custom designed part (such as the ear shell) of the hearing aid, and that this optimization may be carried out with a view to minimize or reduce a size of said ear shell (and/or maximize a distance from the outer ear to the faceplate, which maximization may reduce or eliminate the visibility of the in-the-ear hearing aid during use). It may be understood that during the design process, the battery may 'float' with respect to the faceplate, such as the position and/or orientation of the battery may be optimized independently of the position and/or orientation of the faceplate. This may enable an improved design of the in-the-ear hearing aid with respect to a situation where there is a restriction on the orientation and/or position of the battery, such as where the battery is in a fixed spatial relationship with the faceplate. It may further be an advantage that the hearing instrument may be formed without the need for a battery drawer, which allow the hearing instrument to be smaller than a hearing instrument having such a battery drawer incorporated into the faceplate, or attached to the faceplace, with a battery door formed in the faceplate allowing the battery to be exchanged or replaced.

According to the present description, there is presented a method for providing an in-the-ear hearing aid and further comprising, such as comprising in this order:

Obtaining the data, such as three-dimensional data, representative of an ear shell for said ear canal, Providing the ear shell, such as via three-dimensional printing (optionally with protrusions enabling interference fit with battery) according to said data representative of an ear shell for said ear canal, Attaching, such as via gluing or interference fit, the battery to the ear shell, Attaching a faceplate to the ear shell.

A result of this method may be an in-the-ear hearing aid, possible as according to e.g. the first aspect.

The features and/or technical details outlined above may be combined in any suitable ways.

According to a first alternative aspect, such as an aspect not necessarily limited by the features of the appended claims, there is presented an in-the-ear hearing aid which may comprise, A faceplate, An ear shell, such as a custom ear shell, a battery, and wherein the battery is fixed to the faceplate, wherein a center axis of the battery, such as an axis for which the battery has a minimum moment of inertia and/or an axis around which the battery exhibits circular symmetry, may be neither orthogonal to nor parallel with a plane of the faceplate, such as a best-fit mathematical plane with respect to the faceplate, such as wherein an angle between said axis and said plane is within [5°; 85°], such as within [10°; 80°], such as within [20°; 70°], such as within [30°; 60°]. This first alternative aspect may be combined with any other features or aspects and/or the features of any one of the dependent claims (such as not necessarily including the subject-matter of the independent claim to which the dependent claim refers).

According to the present description, there may be provided an in-the-ear hearing aid wherein the battery is attached to the faceplate via protrusions monolithically integrated with the faceplate or via an insert.

According to the present description, there may be provided an in-the-ear hearing aid wherein the battery is attached exclusively to the faceplate, such as wherein the battery is not attached to the ear shell.

According to the present description, such as an aspect not necessarily limited by the features of the appended claims, there may be presented an in-the-ear hearing aid comprising:

A faceplate

An ear shell, such as a custom ear shell,

A battery, wherein the battery floats relative to the faceplate. This second alternative aspect may be combined with any other aspects of the present disclosure and/or the features of any one of the dependent claims (such as not necessarily including the subject-matter of the independent claim to which the dependent claim refers).

According to a third alternative aspect, such as an aspect not necessarily limited by the features of the appended claims, there is presented an in-the-ear hearing aid comprising:

A faceplate

An ear shell, such as a custom ear shell,

A battery,

A substrate carrying at least one electronic component, such as said electronic component being the battery, wherein said substrate carrying at least one electronic component floats relative to the faceplate or is attached to the faceplate. This third alternative aspect may be combined with any other aspects and/or the features of any one of the dependent claims (such as not necessarily including the subject-matter of the independent claim to which the dependent claim refers).

Further, a plurality of in-the-ear hearing aids according to any of the aspects present herein, such as wherein the electronic components are identical across the plurality of hearing aids, wherein , the shape and/or size of the ear shells among the plurality of in-the-ear hearing aids are different with respect to each other, such as wherein the shape and/or size of each of the ear shells are shaped for respective left and right ears of a specific person, wherein the ear shells have different geometries with respect to each other, and wherein the positions and/or orientations of the batteries with respect to the respective faceplates are different with respect to each other.

Even further, a binaural system comprising two in-the-ear hearing aids according to any one of the preceding aspects may be provided.

Even still further, a method for providing an in-the-ear hearing aid, such as an in-the-ear hearing aid according to any one of previous aspects may be provided. Said method may comprise Obtaining data, such as three-dimensional data, representative of a shape and/or size of an ear canal of a specific person, such as the part of an ear canal extending at least partially from the outer ear to the middle ear, establishing a digital model of the ear shell, such as the custom ear shell, of the hearing aid for said ear canal based on said data, wherein said providing includes determining a position and/or orientation of a battery in an inner space of said ear shell, which position and/or orientation increases or maximizes a distance from the outer ear to the faceplate.

The method may further comprise, such as comprising in this order:

Obtaining the data, such as three-dimensional data, representative of an ear shell for said ear canal, Providing the ear shell, such as via three-dimensional printing according to said data representative of an ear shell for said ear canal, Attaching the battery to the ear shell, Attaching a faceplate to the ear shell.

The features and/or technical details outlined above may be combined in any suitable ways.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the in-the-ear hearing aid, plurality of in-the-ear hearing aids, binaural system and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Figure 1:
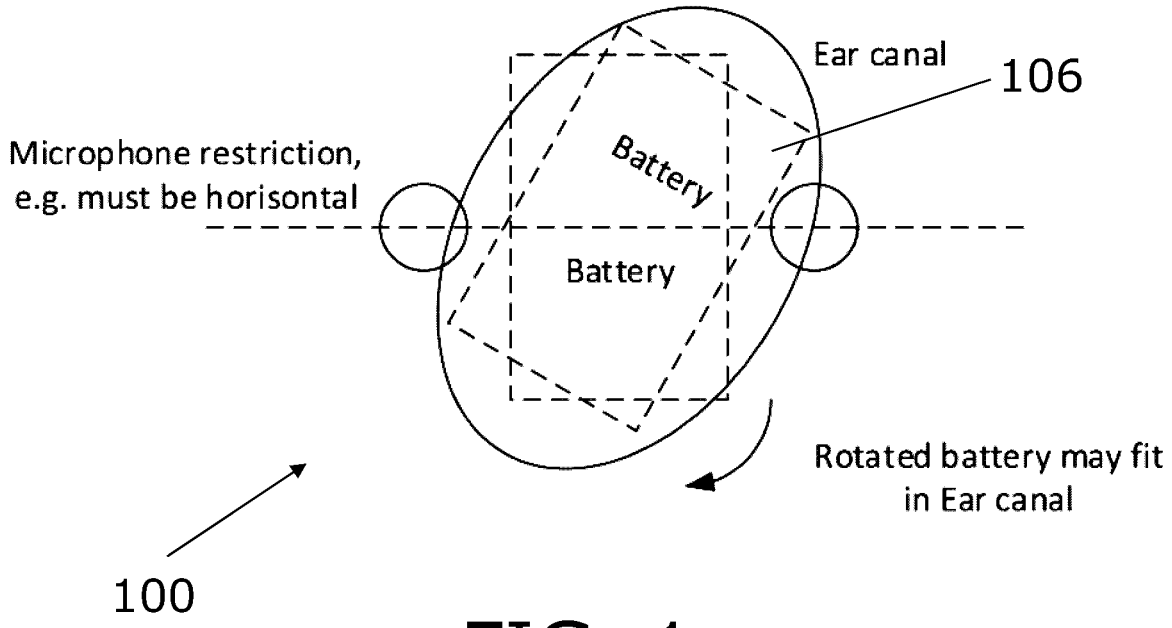
FIG. 1 is a schematic illustration of an in-the-ear hearing aid.

FIG. 1 is a schematic of an in-the-ear hearing aid 100 placed in an ear canal of a user as observed in a direction being parallel with an axis of the ear canal. This in-the-ear hearing aid holds two microphones, which are restricted to lie on a horizontal axis. A first dotted line (forming a rectangle with sides being parallel with the sides of the paper and with the horizontal axis) shows an orientation of the battery 106 according to a restriction that the battery 106 must be placed in this orientation. This restriction may result in an unnecessarily large in-the-ear hearing aid. A second dotted line (forming a rectangle being angled ca. 60° with respect to the rectangle formed by the first dotted line) shows an alternative orientation of the battery 106 which may be the result of an optimization with a view to reduce or minimize a size of the in-the-ear hearing aid, and which may result in a smaller in-the-ear hearing aid than what is possible to design with the restriction that the battery 106 must be oriented as indicated by the first dotted line.

Figure 2:
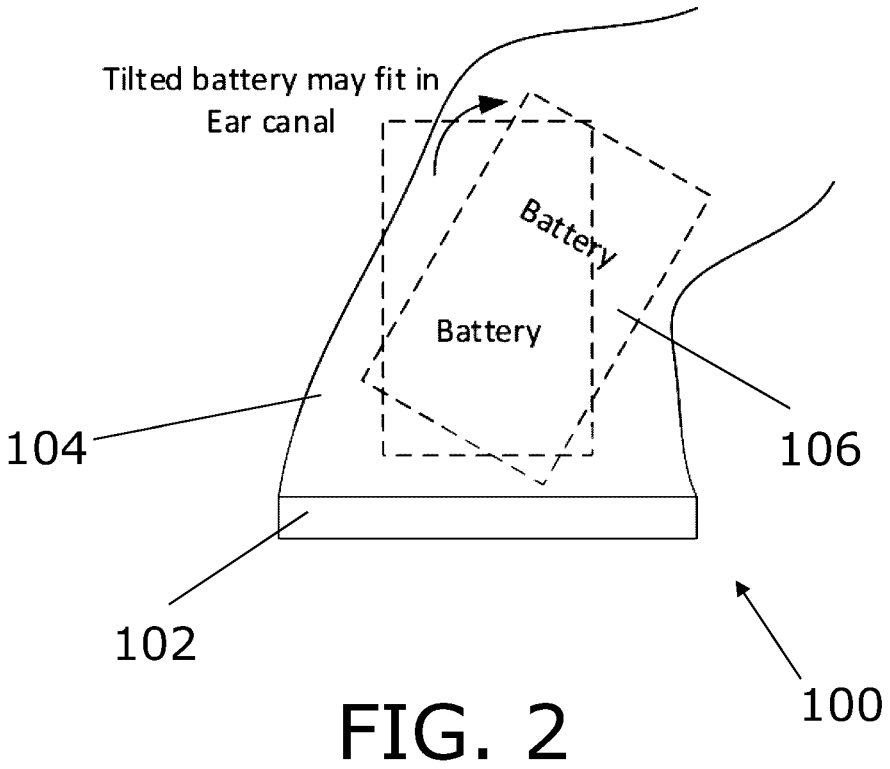
FIG. 2 is a schematic illustration of an in-the-ear hearing aid.

FIG. 2 is a schematic of an in-the-ear hearing aid 100 with an ear shell 104 and a faceplate 102 placed in an ear canal of a user as observed in a direction being orthogonal to an axis of the ear canal but parallel with a plane of the faceplate 102. A first dotted line (forming a rectangle with sides being parallel with the sides of the paper) shows an orientation of the battery 106 according to a restriction that the battery 106 must be placed in this orientation, such as the battery 106 having a center axis being orthogonal to a plane of the faceplate 102. This restriction may result in an unnecessarily large in-the-ear hearing aid. A second dotted line (forming a rectangle being angled ca. 60° with respect to the rectangle formed by the first dotted line) shows an alternative orientation of the battery 106 which may be the result of an optimization with a view to reduce or minimize a size of the in-the-ear hearing aid, and which may result in a smaller in-the-ear hearing aid than what is possible to design with the restriction that the battery 106 must be oriented as indicated by the first dotted line.

Figure 3:
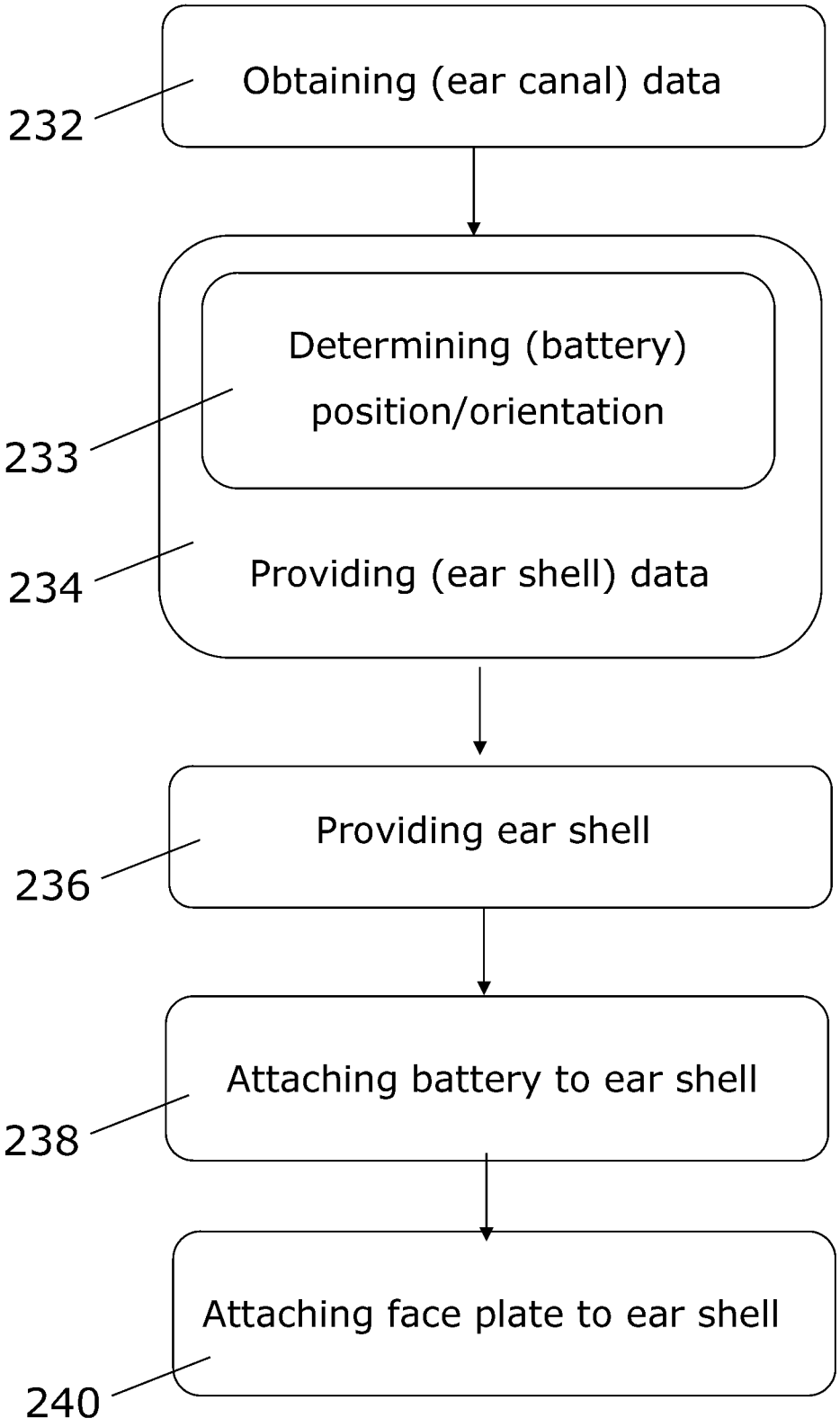
FIG. 3 illustrates a method according to the disclosure.

FIG. 3 illustrates a method according of the disclosure, showing a method for providing an in-the-ear hearing aid, such as an in-the-ear hearing aid according to the first aspect, said method comprising:

Obtaining 232 data, such as three-dimensional data, representative of a shape and/or size of an ear canal of a specific person, such as the part of an ear canal extending at least partially from the outer ear to the middle ear, establishing (234) a digital model of the ear shell, such as the custom ear shell, of the hearing aid for said ear canal based on said data, wherein said providing includes determining 233 a position and/or orientation of a battery 106 in said ear shell 104, which position and/or orientation increases or maximizes a distance from the outer ear to the faceplate 102, and wherein the method is further comprising, such as comprising in this order:

Providing 236 the ear shell 104, such as via three-dimensional printing (optionally with protrusions enabling interference fit with battery) according to said data representative of an ear shell for said ear canal, Attaching 238, such as via gluing or interference fit, the battery 106 to the ear shell, Attaching 240 a faceplate 102 to the ear shell.

The method may be seen as a sequence, but may alternatively simply define individual steps that may be interchanged with other steps or have intermediate steps between them.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. An in-the-ear hearing aid comprising:

an outward facing structure extending about a plane and comprising two microphones arranged so as to lie on a horizontal line when the hearing aid is placed in the ear of a user, an ear shell, and a rechargeable battery, wherein the rechargeable battery is fixed to the ear shell and the battery is placed out of contact with the outward facing structure, and an axis around which the battery exhibits circular symmetry is neither orthogonal to nor parallel with the horizontal line.

2. The in-the-ear hearing aid according to claim 1, wherein the battery is fixed to the ear shell independently of the outward facing structure.

3. The in-the-ear hearing aid according to claim 1, wherein the battery is fixed exclusively to the ear shell.

4. The in-the-ear hearing aid according to claim 1, wherein an angle between said axis and said horizontal line is within [5°; 85°].

5. The in-the-ear hearing aid according to claim 1, wherein the hearing aid further comprises an induction coil configured for wireless charging of the rechargeable battery.

6. The in-the-ear hearing aid according to claim 1, wherein the outward facing structure comprises an antenna configured for high frequency wireless communication.

7. The in-the-ear hearing aid according to claim 1, wherein the battery is fixed to the ear shell via protrusions monolithically integrated with the ear shell.

8. The in-the-ear hearing aid according to claim 1, comprising a substrate carrying at least one electronic component wherein said substrate carrying at least one electronic component floats relative to the outward facing structure or is attached to the outward facing structure.

9. The in-the-ear hearing aid according to claim 1, wherein a protection layer is applied to at least one electronic component in the in-the-ear hearing aid.

10. The in-the-ear hearing aid according to claim 1, wherein the ear shell is monolithic.

11. The in-the-ear hearing aid according to claim 1, wherein the in-the-ear hearing aid comprises a housing, said housing comprising the outward facing structure and the ear shell, and wherein the in-the-ear hearing aid further comprises a telecoil arranged within the housing.

12. The in-the-ear hearing aid according to claim 1, wherein the ear shell is monolithic.

* * * * *